US009862023B2

(12) United States Patent
Marques et al.

(10) Patent No.: US 9,862,023 B2
(45) Date of Patent: Jan. 9, 2018

(54) METHOD FOR MANUFACTURING A SHELL MOLD FOR PRODUCTION BY LOST-WAX CASTING OF BLADED ELEMENTS OF AN AIRCRAFT TURBINE ENGINE

(71) Applicant: SAFRAN AIRCRAFT ENGINES, Paris (FR)

(72) Inventors: François Marques, Bouffemont (FR); Wilfrid Docquois, Le Mesnil Aubry (FR); Eric Eberschveiller, L'Isles Adam (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/324,390

(22) PCT Filed: Jun. 29, 2015

(86) PCT No.: PCT/FR2015/051769

§ 371 (c)(1),
(2) Date: Jan. 6, 2017

(87) PCT Pub. No.: WO2016/005674

PCT Pub. Date: Jan. 14, 2016

(65) Prior Publication Data

US 2017/0151605 A1 Jun. 1, 2017

(30) Foreign Application Priority Data

Jul. 7, 2014 (FR) ..... 14 56522

(51) Int. Cl.
*B22C 9/08* (2006.01)
*B22C 9/04* (2006.01)
(Continued)

(52) U.S. Cl.
CPC ..... *B22C 9/24* (2013.01); *B05D 1/18* (2013.01); *B22C 7/02* (2013.01); *B22C 9/04* (2013.01);
(Continued)

(58) Field of Classification Search
CPC .. B22C 7/02; B22C 9/04; B22C 9/043; B22C 9/08; B22C 9/082; B22C 9/088
(Continued)

(56) References Cited

U.S. PATENT DOCUMENTS 4,240,493 A * 12/1980 Wilmarth ..... B22C 9/04 164/244
2015/0027653 A1 1/2015 Guerche et al.

FOREIGN PATENT DOCUMENTS

FR 2 985 924 A1 7/2013

OTHER PUBLICATIONS

International Search Report issued in Patent Application No. PCT/FR2015/051769 dated Oct. 2, 2015.
(Continued)

*Primary Examiner* — Kevin E Yoon
*Assistant Examiner* — Jacky Yuen
(74) *Attorney, Agent, or Firm* — Pearne & Gordon LLP

(57) ABSTRACT

A method for manufacturing a shell mold for the production by lost-wax casting of bladed elements (1) of an aircraft turbine engine, including the following steps: creating an assembly (200) including a wax pattern (100) as well as a device for forming a cup for pouring metal (32*b*) and having an end surface (40*a*); depositing a hot wax coating layer on at least one portion of the end surface (40*a*); forming the shell mold around the assembly (200). In addition, the method includes, between steps b) and c), the implementation of a step of structuring the coating layer intended for reinforcing the adhesion between the layer (46) and the shell
(Continued)

mold, and including the production of recesses (62) and projections (60) on the still-malleable coating layer.

10 Claims, 6 Drawing Sheets

(51) Int. Cl.

| | |
|---|---|
| ***B22C 7/02*** | (2006.01) |
| ***B22C 9/24*** | (2006.01) |
| ***B22C 9/10*** | (2006.01) |
| ***B22D 25/02*** | (2006.01) |
| ***B05D 1/18*** | (2006.01) |
| ***F01D 5/12*** | (2006.01) |
| ***F01D 9/02*** | (2006.01) |
| ***F04D 29/32*** | (2006.01) |
| ***F04D 29/54*** | (2006.01) |

(52) U.S. Cl.
CPC ..... *B22C 9/082* (2013.01); *B22C 9/103* (2013.01); *B22D 25/02* (2013.01); *F01D 5/12* (2013.01); *F01D 9/02* (2013.01); *F04D 29/324* (2013.01); *F04D 29/542* (2013.01); *F05D 2220/323* (2013.01); *F05D 2230/21* (2013.01)

(58) Field of Classification Search
USPC ..... 164/138
See application file for complete search history.

(56) References Cited

OTHER PUBLICATIONS

Written Opinion issued in Patent Application No. PCT/FR2015/051769 dated Oct. 2, 2015.
French Search Report issued in Patent Application No. FR 14 56522 dated Mar. 10, 2015.

* cited by examiner

METHOD FOR MANUFACTURING A SHELL MOLD FOR PRODUCTION BY LOST-WAX CASTING OF BLADED ELEMENTS OF AN AIRCRAFT TURBINE ENGINE

FIELD OF THE INVENTION

The invention relates to the field of clustered manufacturing of bladed elements of an aircraft turbine engine, by the lost-wax casting technique. Each bladed element may be a sector comprising a plurality of blades, such as a low-pressure dispenser sector, or be an individual blade, such as a mobile compressor or turbine impeller blade.

The invention relates more particularly to the manufacture of the shell mold in cluster form, wherein the metal is intended to be cast to obtain the bladed elements of the turbine engine.

The invention relates to all types of aircraft turbine engines, in particular turbojets and turboprops.

STATE OF THE RELATED ART

From the prior art, the use of the lost-wax casting technique is known for simultaneously manufacturing a plurality of aircraft turbine engine bladed elements, such as mobile blades. Such a technique is for example described in the document FR 2 985 924.

As a reminder, lost-wax precision casting consists of creating in wax, by injecting into tools, a pattern of each of the bladed elements sought. Assembling these patterns on casting arms also made of wax, in turn connected to a metal dispenser made of wax, makes it possible to create a cluster which is subsequently dipped in various substances in order to a form a ceramic shell mold of substantially uniform thickness around same.

The method is continued by melting the wax, which then leaves the exact imprint thereof in the ceramic, wherein the molten metal is poured, via a casting cup assembled on the metal dispenser. After cooling the metal, the shell mold is destroyed and the metal parts are separated and finished.

This technique offers the advantage of dimensional precision, making it possible to reduce or even do away with some machining operations. Furthermore, it offers a very good surface finish.

In practice, the shell mold is created not only around the wax pattern, but also around the casting cup assembled with this pattern. The pattern generally has an end surface situated on a cover, this surface facing downward during the passage through the drying tunnel intended to solidify the shell mold. During this drying, the assembly moving in the tunnel is subject to vibrations. Due to these vibrations and the significant mass of the portion of the shell mold covering the cover of the cup, falls of shell mold blocks are frequently observed. These blocks are then found on the floor and need to be removed, for example using costly conveyor belts. Alternatively, for the removal of these blocks outside the facility, frequent cleaning operations may be carried out. However, these operations are also costly, and liable to involve risks in respect of health, safety and the environment (HSE risks).

OBJECT OF THE INVENTION

The aim of the invention is thus that of remedying at least partially the drawbacks mentioned above, relative to the embodiments of the prior art.

For this purpose, the invention first relates to a method for manufacturing a shell mold for the production by lost-wax casting of bladed elements of an aircraft turbine engine, said shell mold in cluster form comprising a plurality of bladed shell mold elements each intended to obtain one of said bladed turbine engine elements, said method comprising the following steps:

a) creating an assembly about which the shell mold is intended to be formed, the assembly including a wax pattern as well as a device for subsequently forming a cup for pouring metal, said device having an end surface;

b) depositing a hot wax coating layer about at least one portion of said assembly, such that said coating layer covers at least one portion of the end surface of the device intended to subsequently form the cup for pouring metal; and c) forming the shell mold about said assembly.

According to the invention, the method further includes, between steps b) and c), the implementation of a step of structuring the coating layer intended for reinforcing the adhesion between this layer and the shell mold to be formed, and including the production of recesses and projections on the still-malleable coating layer.

As such, the invention cleverly envisages carrying out a structuring of the coating layer after the deposition thereof, in order to create a raised surface favorable for superior adhesion of the shell mold intended to be formed about this coating layer.

The risks of shell mold blocks falling are thus considerably reduced. For this reason, it is no longer necessary to use costly means for removing the blocks that have fallen on the floor, such as conveyor belts as proposed in the prior art. This advantageously results in a reduction in the costs of the facility devoted to the implementation of the method for manufacturing the shell mold.

The invention further has at least one of the following optional features, taken alone or in combination.

The step for structuring the coating layer is implemented by inserting a plurality of imprinting elements in said still-malleable coating layer, causing the formation of said projections about the imprinting elements, then by removing the latter revealing recesses, each surrounded by one of said projections.

The imprinting elements are studs, preferably with an external surface head having a general spherical cap shape, for example a general hemispherical shape.

The ratio between the maximum external diameter of each stud, and the external diameter of the end surface of the device, is less than 20.

The number of studs is between 3 and 20.

The step for structuring the coating layer is implemented by applying a pressure from a supporting member bearing the plurality of imprinting elements, against said still-malleable coating layer. Said application of pressure is performed by moving said assembly, against the supporting member remaining stationary. Alternatively, the supporting member could be moved in order to come into contact with the coating layer, without leaving the scope of the invention.

The step for forming the shell mold about said assembly includes at least one drying operation performed at least in part with said end surface facing downward, and preferably with said shell mold, surrounding the assembly, moved inside a drying station.

The step for forming the shell mold is performed by dip coating.

The invention also relates to a method for manufacturing by lost-wax casting a plurality of bladed elements of an aircraft turbine engine, this method including the production of a shell mold using a method as described above, followed by casting of metal in the shell mold.

Further advantages and features of the invention will emerge in the non-limiting detailed description hereinafter.

BRIEF DESCRIPTION OF THE FIGURES

This description will be given with reference to the appended drawings wherein.

DETAILED DESCRIPTION OF PREFERRED EMBODIMENTS

Figure 1:
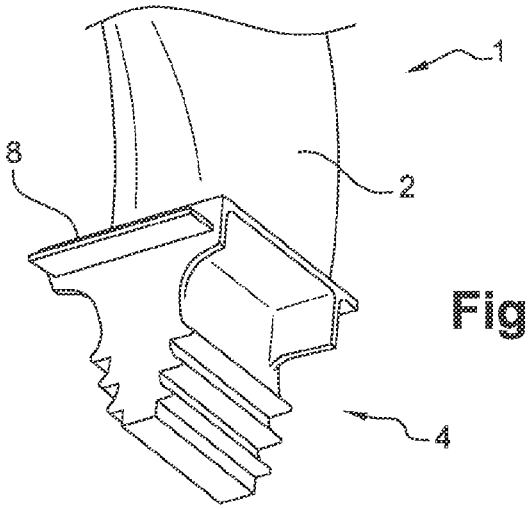
FIG. 1 represents a perspective view of a bladed element of a turbine engine intended to be obtained by implementing the method according to the present invention, said bladed element being in the form of a mobile high-pressure turbine blade.

With reference to FIG. 1, an example of a mobile high-pressure turbine blade 1 for an aircraft turbine engine is represented. Conventionally, this blade 1 includes a blade 2 extending from one end 4 forming a blade root, and including a platform 8 intended to define a main gas flow jet.

The aim of the invention is that of manufacturing the mobile blade 1 from a shell mold intended to be produced using a method specific to the invention, one preferred embodiment whereof will now be described with reference to FIGS. 2 to 10. Nevertheless, it is noted that the invention may also be applied to the manufacture of mobile compressor blades, or to the manufacture of compressor or turbine stator blades, produced separately or in sectors including a plurality of blades.

For the manufacture of the shell mold, a wax pattern is first created, also known as a replica, about which a ceramic shell mold is intended to be subsequently formed.

Figure 2:
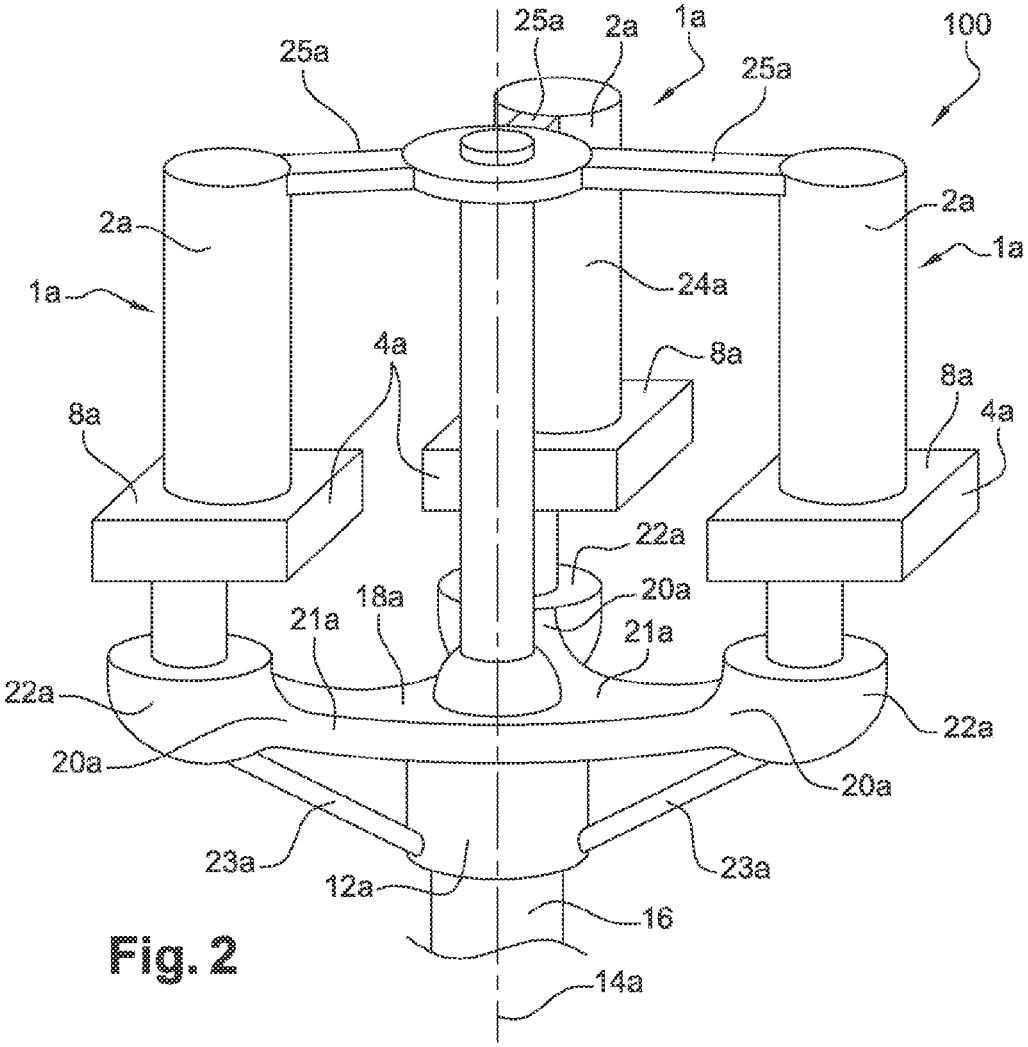
FIG. 2 represents a perspective view of a wax pattern used for manufacturing a shell mold for the production, by lost-wax casting, of blades such as that shown in FIG. 1.

In FIG. 2, the wax model 100 is represented in an inverted position with respect to the position wherein the shell mold is subsequently filled with metal. This inverted position facilitates the assembly operation of the various constituent elements of the wax pattern, which will now be described.

The model 100 firstly includes a portion for dispensing metal, referenced 12*a*. It adopts a solid revolutionary, cylindrical or conical shape, having a central axis 14*a* aligned with the central axis of the assembly of the wax pattern 100. This axis 14*a* is oriented vertically, and thus considered to represent the direction of the height. This dispensing portion 12*a* is attached directly to a specific tool 16, above which it is situated.

The portion 12*a* is terminated at the top by an end 18*a* of greater diameter, from which a plurality of portions 20*a* extend radially for the formation of a plurality of casting arms. The portions 20*a* are herein three in number, distributed at 120° about the axis 14*a*. Each portion 20*a* thus includes a first end 21*a* connected to the enlarged end 18*a* of the dispensing portion 12*a*, and extends in a straight or slightly curved manner up to the second end 22*a*.

For each portion forming an arm 20*a*, a wax/ceramic securing reinforcement 23*a* may be envisaged between the dispensing portion 12*a* and the second end 22*a* of the portion 20*a*.

Furthermore, from each second end 22*a*, a wax replica 1*a* of the turbine blade represented in FIG. 1 is attached. This replica 1*a* thus includes a blade 2*a*, extending from an end 4*a* forming a blade root, and comprising a platform 8*a*. In FIG. 2, the blade replicas 1*a* were only represented schematically.

Figure 3:
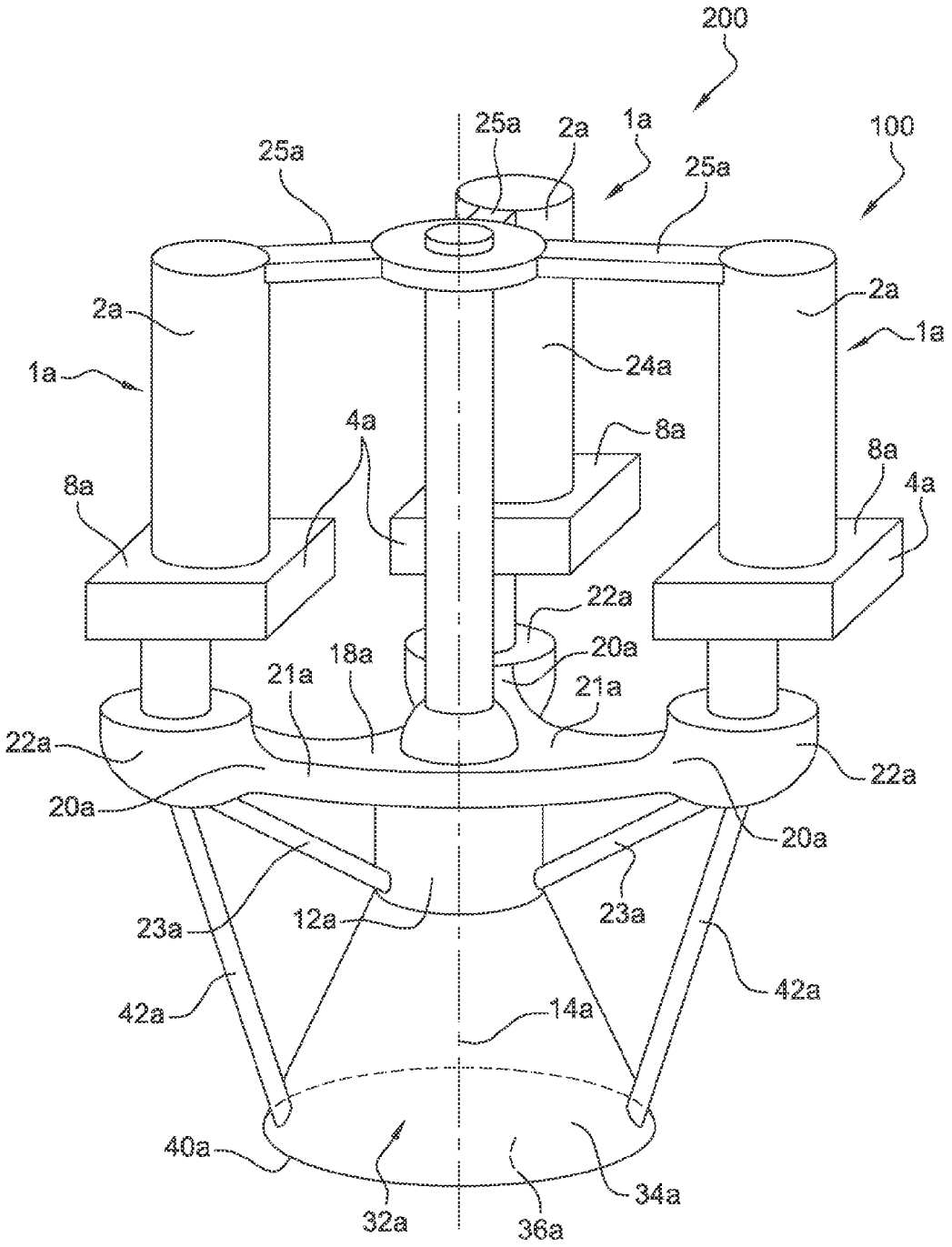
FIGS. 3 to 10 represent schematically different steps of the method for manufacturing the shell mold.
Figure 4:
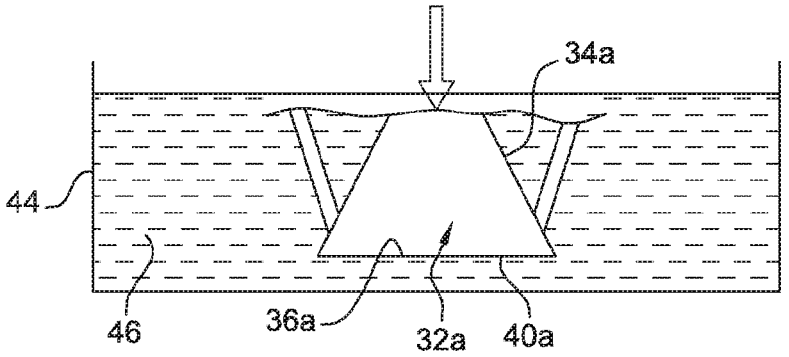
Figure 5:
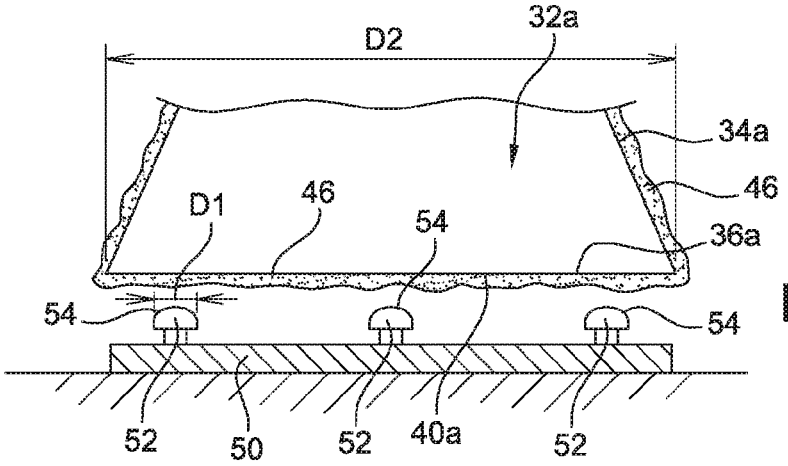
Figure 5A:
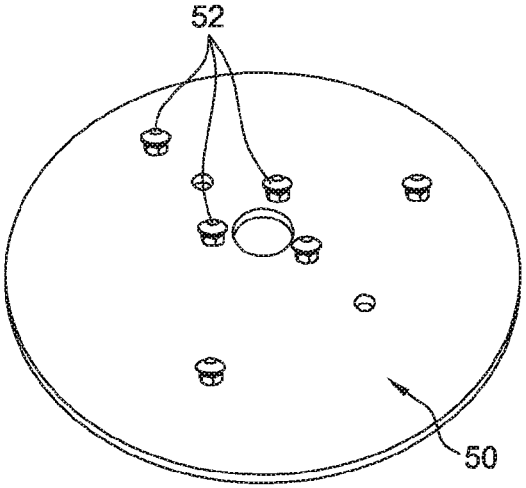
Figure 5B:
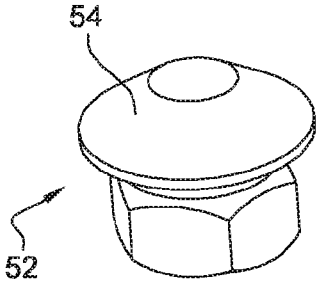

It is noted that while the replicas 1*a* have been represented with the blade root 4*a* arranged at the bottom with respect to the blade 2*a* in the position in FIG. 3, this root 4*a* could alternatively be arranged at the top, such that, once the shell mold has been inverted to cast the metal, the metal only reaches the root after having passed through the blade portion.

The wax blades 1*a* extend upward, being arranged about the axis 14*a*, and also about a central wax supporting member 24*a* extending along the same axis from the end 18*a* of the dispensing portion 12*a*. The supporting member 24*a* is preferentially in the form of a rod having the axis 14*a*, which extends up to the vicinity of the blade heads 2*a*.

As seen in FIG. 2, for each wax blade 1*a*, a wax/ceramic securing reinforcement 25*a* may be envisaged between the upper end of the central support rod 24*a*, and the blade head. Similarly, wax/ceramic securing reinforcements (not shown) may interconnect adjacent blade heads of the different blades 1*a*.

The wax blades 1*a* form the peripheral wall of the wax replica 100. They are spaced circumferentially from one another, and define an internal space centered on the axis 14*a*, wherein the central support rod 24*a* is thus situated.

As represented schematically in FIG. 3, once the wax replica 100 has been produced, a device 32*a* is assembled thereon intended to subsequently form a cup for pouring metal into the shell mold. The device 32*a* includes a conical element 34*a* centered on the axis 14*a* and flaring at the bottom from a small-sized section rigidly connected to the lower end of the dispensing portion 12*a*. The conical element 34*a* is preferably produced hollow, and closed at the lower end thereof by a cover 36*a*, the external surface 40*a* whereof forms an end surface of the device 32*a*. Alternatively, the device 32*a* could be produced solid, in a wax intended to be subsequently removed when removing the wax pattern 100.

Optionally, reinforcement elements 42*a* may subsequently be produced between the device 32*a* and the arms 20*a*.

The wax pattern 100 and the device 32*a* form collectively an assembly 200 about which the shell mold is intended to be formed. Nevertheless, before the step for forming the shell mold, a step is envisaged for depositing a hot wax coating layer, as represented schematically in FIG. 4. This depositing step is also referred to as "dip seal". It is intended to partially dip-coat the assembly 200 in a vat 44 of liquid hot wax 46, so as to enable good adhesion of the shell mold subsequently formed. As an indication, the dip coating is herein performed so as to immerse the entire device 32*a* in the hot wax 46, and optionally a lower part of the wax model 100. In addition, after this dip coating step, a hot wax coating layer 46 covers the entire end surface 40*a* defined by the cover 36*a* of the device 32*a*, as represented schematically in FIG. 5. A hot wax coating layer 46 also covers the external surface of the conical element 34*a*.

One of the specificities of the invention consists of structuring at least the layer 46 covering the end surface 40*a*, when this layer is still malleable, i.e. before it has completely cooled.

For this purpose, a tool as shown in FIGS. 5, 5*a*, 5*b* and 6 is envisaged. It consists of a supporting member 50 bearing a plurality of imprinting elements 52 in the form of studs, with a hemispherical external surface head 54. The number of these studs 52, the size and arrangement thereof are selected according to the needs encountered. By way of indicative example, the number of studs 52 projecting from the supporting member 50 may be between 3 and 20, whereas the ratio between the external diameter D1 thereof and the external diameter D2 of the cover is preferentially less than 20.

Figure 6:
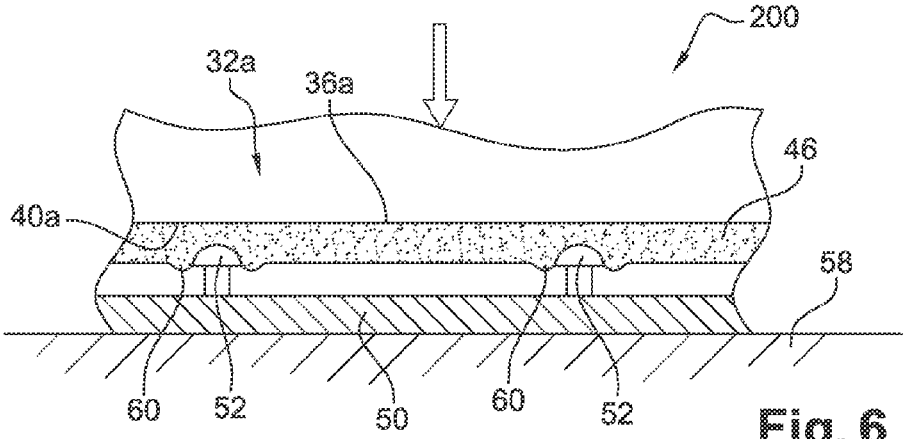

In order to perform the step for structuring the coating layer 46, the assembly 200 is moved against the supporting member 52 remaining stationary on a specific station 58, represented schematically in FIG. 6. The movement of the assembly 200 against the supporting member 50 bearing the studs 52 is preferably performed vertically downward, with the end surface 40*a* oriented horizontally. The pressure applied results in the studs 52 being inserted into the layer 46, creating an expulsion of wax about same. This expulsion, in the form of a bead surrounding each stud 52, generates a projection 60. After removing the studs 52, the latter give way to recesses 62 shown in FIG. 7, each recess being surrounded by a projection 60.

Figure 7:
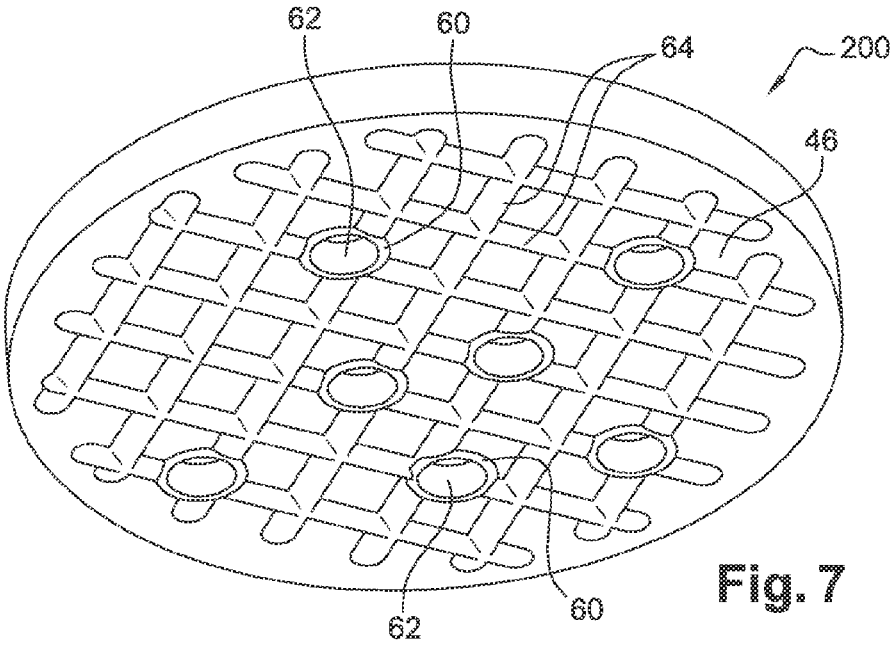

The depth of the recesses 62 is less than the thickness of the coating layer 46, such that wax is found at the bottom of each recess. The structuring performed makes it possible, clearly and inexpensively, to reinforce the adhesion between the layer 46 covering the end surface 40*a* of the cover 36*a*, and the shell mold intended to be formed subsequently. This structuring is added to the optional presence of an initial structuring of the end surface 40*a* of the cover 36*a*, for example using goffering 64 as seen in FIG. 7. It should however be specified that this goffering 64 is covered with the coating layer 46, which tends to attenuate the raised surfaces of the goffering, and thus lower the adhesion power thereof. The structuring according to the invention, generated after the deposition of the coating layer 46, makes it possible to effectively reinforce the adhesion power of this layer to the shell mold subsequently formed.

Figure 9:
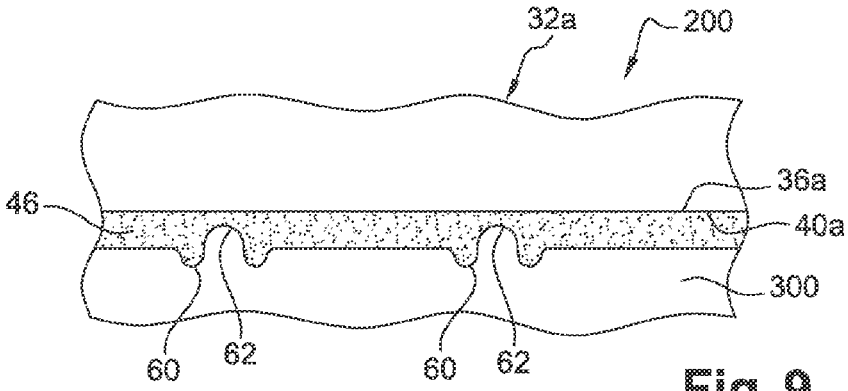
Figure 8:
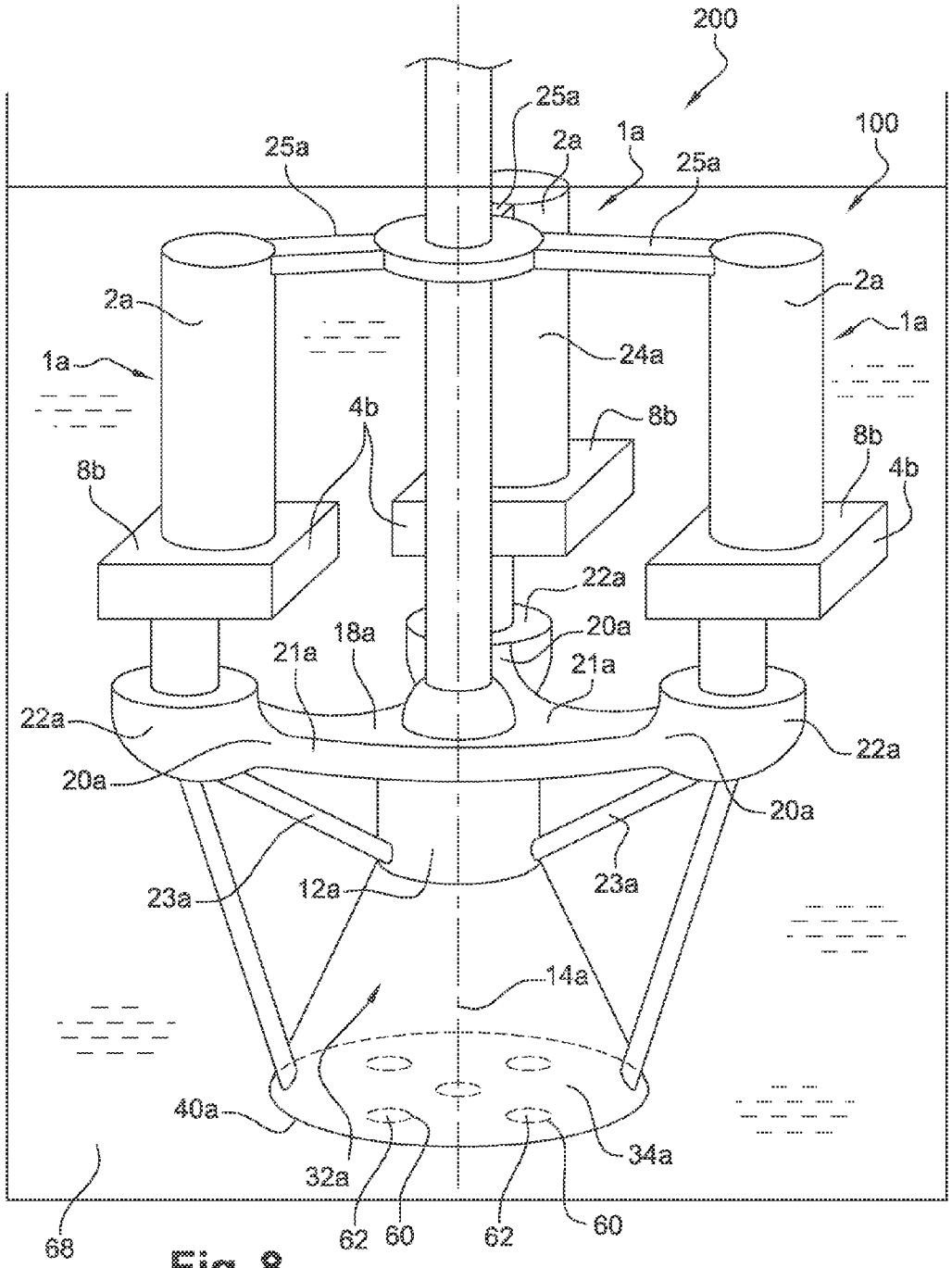
Figure 10:
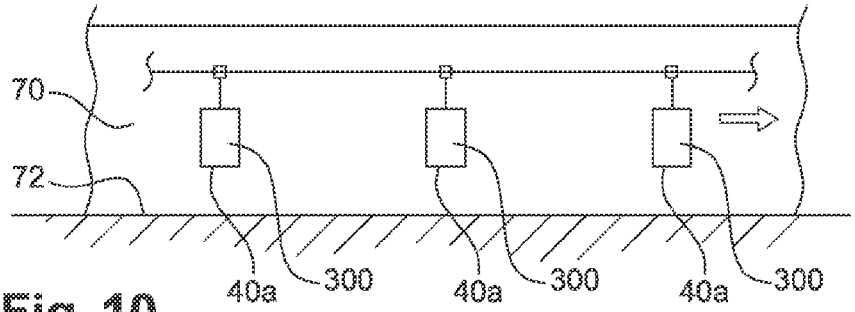

In this regard, with reference to FIGS. 8 and 9, the step for forming the ceramic shell mold is then implemented, by dip-coating the assembly 200 in successive baths 68, one whereof is represented schematically in FIG. 8. This step is known per se and will not be described further, apart from the fact that during the embodiment thereof, the shell mold 300 being formed is deposited in the recesses 62 and about beads 60 of the coating layer 46. These layers act as anchor points of the shell mold, thus promoting the adhesion thereof to the cover 36*a*.

During the formation of the shell mold 300, at least one drying operation is performed intended to dry same. This operation, represented schematically in FIG. 10, consists of conveying one or a plurality of shell molds 300 inside a drying station also known as a drying tunnel 70, with the shell molds 300 suspended above the floor 72. During this movement, the end surface 40*a* of the cover is oriented horizontally, downward, but the risks of uncoupling of the shell mold blocks is reduced considerably by the structuring 60, 62 previously carried out on the coating layer 46 covering the end surface 40*a*.

Figure 11:
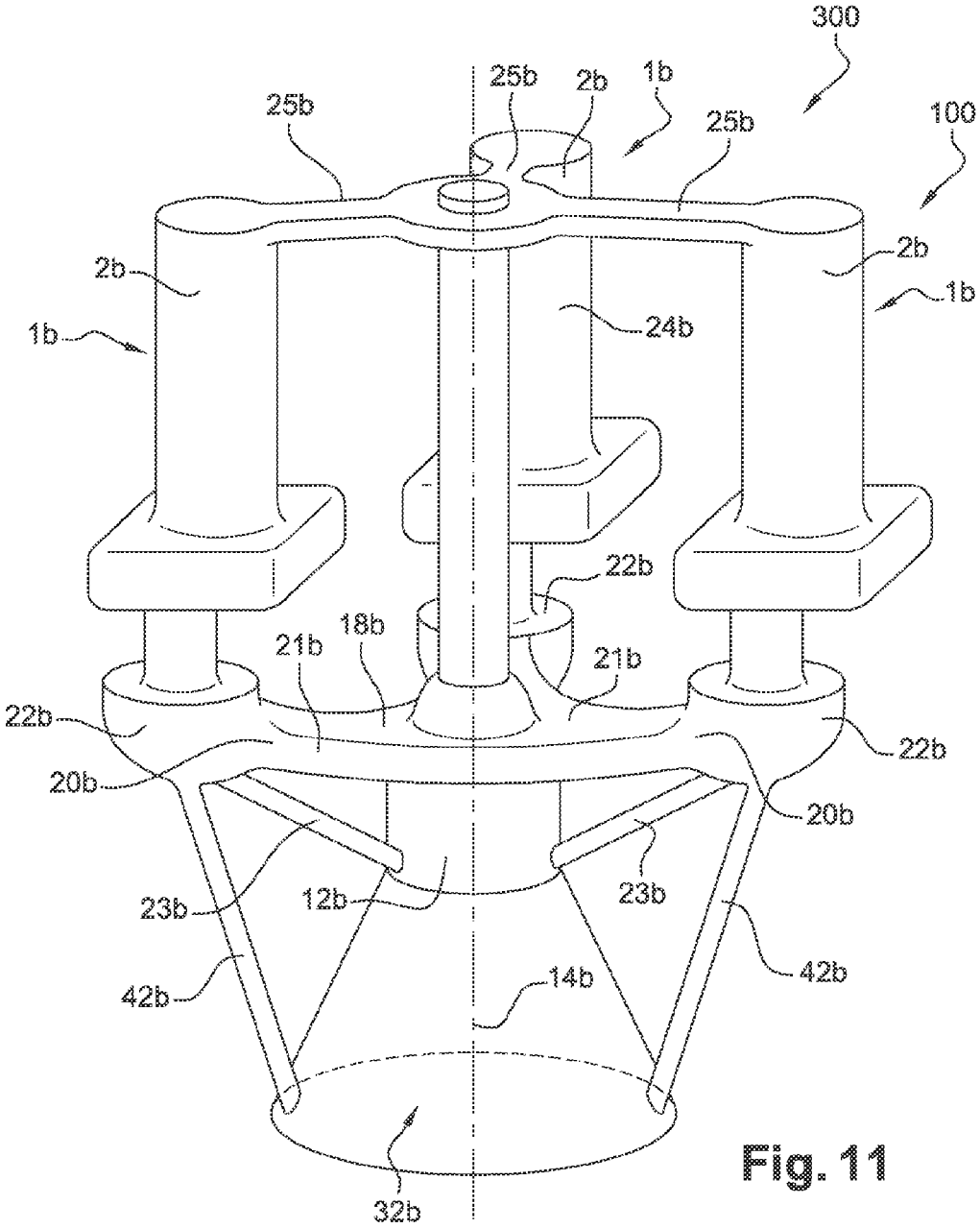
FIG. 11 represents a schematic view of such a shell mold obtained by implementing the manufacturing method represented schematically in the preceding figures.

After drying, the shell mold 300 which is obtained is represented schematically in FIG. 11. It also has a general cluster shape, and obviously includes similar elements to those of the wax replica 100 and the device 32*a* cited above. These shell mold elements will now be described, with the shell mold represented in an inverted position with respect to the position wherein it is subsequently filled with metal.

It consists first of the cup 32*b*, followed by the metal dispenser, referenced 12*b*. The latter thus has a hollow revolutionary, cylindrical or conical shape, having a central axis 14*b* which is aligned with the central axis of the shell mold 300. This axis 14*b* is oriented vertically, and thus considered to represent the direction of the height.

The dispenser 12*b* is terminated at the top with a hollow end 18*b* of greater diameter, from which a plurality of metal casting arms 20*b* extend radially. The arms 20*b* are herein three in number, distributed at 120° about the axis 14*b*. Each arm 20*b* thus includes a first end 21*b* connected to the enlarged end of the dispenser 12*b*, and extends in a straight or slightly curved manner up to a second end 22*b*.

Each arm 20*b* is thus envisaged to be hollow and form a metal supply duct after removing the wax 20*a*. Herein also, a securing reinforcement 23*b* may be envisaged between the dispensing portion 12*b* and the second end 22*b* of each arm 20*b*.

From each second end 22*b*, a bladed shell mold element 1*b* is situated. These elements 1*b* are referred to as bladed as, after removing the wax replica 1*a*, they each form internally an imprint corresponding to one of the blades 1.

The bladed element 1*b*, also referred to as shell mold blade, thus includes a blade portion 2*b* defining adjacent blade imprints, this portion 2*b* extending from one end 4*b* forming a blade root, and including a platform 8*b*. In FIG. 11, the shell mold blades 1*b* have been represented only schematically.

The bladed elements 1*b* thus extend upward, being arranged about the axis 14*b*, and also about a central supporting member 24*b* extending along said axis from the end 18*b* of the dispenser 12*b*. The supporting member 24*b* preferentially takes the form of a hollow cylinder having the axis 14*b*, which extends up to the vicinity of the ends 6*b* of the bladed elements 1*b*.

Furthermore, for each bladed element 1*b*, a securing reinforcement 25*b* may be envisaged between the upper end of the central support rod 24*b*, and the blade head. Similarly, wax/ceramic securing reinforcements (not shown) may interconnect adjacent blade heads of the different shell mold blades 1*b*. Finally, reinforcing elements 42*b* are arranged between the cup 32*b* and the casting arms 20*b*.

After obtaining the shell mold 300 and removing the wax replica 100 contained therein, and removing the cover initially closing the cup, the shell mold is preheated at a high temperature in a dedicated furnace, for example at 1150° C., in order to promote the fluidity of the metal in the shell mold during casting.

At the shell mold preheating outlet, metal from a melting furnace is cast in imprints via the cup 32*b* shown, with the shell mold in the inverted position with respect to that shown in FIG. 11, i.e. with the cup 32*b* open at the top and once again the axis 14*b* oriented vertically.

The molten metal thus successively travels through the cup 32*b*, the dispenser 12*b*, the casting arms 20*b*, and the bladed shell mold elements 1*b*, merely flowing gravitationally. It is noted that prior to casting, the central supporting member 24*b* preferably has the end thereof sealed so as to not be filled with metal, and such that the metal cast necessarily passes through the arms 20*b* before entering the bladed elements 1*b*. The reinforcements 23*b*, 25*b*, 42*b* are preferentially solid, made of ceramic, thus not traversed by the molten metal during the casting in the shell mold 300.

After cooling the metal, the shell mold is destroyed, and the mobile blades 1 are separated from the cluster for any machining and finishing and inspection operations required.

Obviously, various modifications may be made by those skilled in the art to the invention described above, merely by way of non-limiting examples.

The invention claimed is:

1. Method for manufacturing a shell mold for the production by lost-wax casting of a plurality of bladed elements of an aircraft turbine engine, said shell mold in cluster form comprising a plurality of bladed shell mold elements each intended to obtain one of said bladed turbine engine elements, said method comprising the following steps:

a) creating an assembly about which the shell mold is intended to be formed, the assembly including a wax pattern as well as a device for subsequently forming a cup for pouring metal, said device having an end surface;

b) depositing a hot wax coating layer around at least one portion of said assembly, such that said coating layer covers at least one portion of the end surface of the device intended to subsequently form the cup for pouring metal; and c) forming the shell mold about said assembly;

wherein the method further includes, between steps b) and c), the implementation of a step of structuring the coating layer covering said end surface, this structuring step being intended to reinforce the adhesion between this layer and the shell mold to be formed, and including the production of recesses and projections on the still-malleable coating layer.

2. Method according to claim 1, wherein the step for structuring the coating layer is implemented by inserting a plurality of imprinting elements in said still-malleable coating layer, causing the formation of said projections about the imprinting elements, then by removing the latter revealing recesses, each surrounded by one of said projections.

3. Method according to claim 2, wherein the imprinting elements are studs with an external surface head having a general spherical cap shape.

4. Method according to claim 3, wherein the ratio between the maximum external diameter of each stud, and the external diameter of the end surface of the device, is less than 20.

5. Method according to claim 3, wherein the number of studs is between 3 and 20.

6. Method according to claim 2, wherein the step for structuring the coating layer is implemented by applying a pressure from a supporting member bearing the plurality of imprinting elements, against said still-malleable coating layer.

7. Method according to claim 6, wherein said application of pressure is performed by moving said assembly, against the supporting member remaining stationary.

8. Method according to claim 1, wherein the step for forming the shell mold about said assembly includes at least one drying operation performed at least in part with said end surface facing downward, and with said shell mold, surrounding the assembly, moved inside a drying station.

9. Method according to claim 1, wherein the step for forming the shell mold is performed by dip coating.

10. Method for manufacturing by lost-wax casting a plurality of bladed elements of an aircraft turbine engine, wherein the method includes the production of a shell mold using the method according to claim 1, followed by casting of metal in the shell mold.

* * * * *